US007135077B2

(12) United States Patent
Warner

(10) Patent No.: US 7,135,077 B2
(45) Date of Patent: Nov. 14, 2006

(54) THICK PRODUCTS MADE OF HEAT-TREATABLE ALUMINUM ALLOY WITH IMPROVED TOUGHNESS AND PROCESS FOR MANUFACTURING THESE PRODUCTS

(75) Inventor: Timothy Warner, Voreppe (FR)

(73) Assignee: Pechiney Rhenalu, Paris (FR)

( * ) Notice: Subject to any disclaimer, the term of this patent is extended or adjusted under 35 U.S.C. 154(b) by 0 days.

(21) Appl. No.: 09/855,556

(22) Filed: May 16, 2001

(65) Prior Publication Data

US 2002/0011289 A1 Jan. 31, 2002

Related U.S. Application Data

(60) Provisional application No. 60/206,775, filed on May 24, 2000.

(51) Int. Cl.
*C22C 21/10* (2006.01)

(52) U.S. Cl. ..... 148/417; 420/532

(58) Field of Classification Search ..... 148/417; 420/532

See application file for complete search history.

(56) References Cited

U.S. PATENT DOCUMENTS 5,865,911 A * 2/1999 Miyasato et al. ..... 148/439
6,027,582 A 2/2000 Shahani et al.

FOREIGN PATENT DOCUMENTS

| | | |
|---|---|---|
| EP | 0942071 | 9/1999 |
| JP | 83675 | 1/1996 |
| JP | 9209056 | 8/1997 |
| JP | 10-298691 | 11/1998 |
| JP | 10-317114 | 12/1998 |
| JP | 2000-054051 A * | 2/2000 |
| JP | 200054051 | 2/2000 |
| JP | 200054054 | 2/2000 |

OTHER PUBLICATIONS

"ASM Handbook: vol. 9 Metallography and Microstructures", ASM International, 1985, pp. 366-367.*
"ASM Handbook: vol. 15: Casting", ASM International, (1988), pp. 476-481.*

* cited by examiner

*Primary Examiner*—George Wyszomierski
*Assistant Examiner*—Janelle Morillo
(74) *Attorney, Agent, or Firm*—Dennison, Schultz, Dougherty & MacDonald

(57) ABSTRACT

The object of the invention is a rolled, forged or extruded aluminum alloy product more than 12 mm thick, heat treated by solutionizing, quenching and artificial aging, with a microstructure characterized by the following parameters:

the fraction of recrystallized grains measured between one-quarter thickness and mid-thickness of the final wrought product is smaller than 35% by volume;

the characteristic intercept distance between recrystallized areas is greater than 250 μm, preferably greater than 300 μm and most preferably greater than 350 μm.

3 Claims, 3 Drawing Sheets

THICK PRODUCTS MADE OF HEAT-TREATABLE ALUMINUM ALLOY WITH IMPROVED TOUGHNESS AND PROCESS FOR MANUFACTURING THESE PRODUCTS

FIELD OF THE INVENTION

The invention relates to heat-treatable aluminum alloy products in the 2000, 4000, 6000 or 7000 series according to the Aluminum Association designation system, of thickness greater than 12 mm, and a process for manufacturing these products by casting, hot transformation, solution heat treating, quenching and aging. These products may be plates or rolled plates, forged blocks or extruded sections. For products that have a shape other than a parallelepiped shape, the thickness of the product means the maximum quenching thickness, in other words the maximum value for all points within the product of twice the distance to be passed through perpendicular to the nearest surface in contact with the quenching medium.

DESCRIPTION OF THE RELATED ART

Aluminum alloy products in the 2000 or 7000 series are used particularly for aeronautical construction, and in the heat treated temper. Such applications require a set of properties that are sometimes mutually contradictory, such as:

- a high mechanical strength in order to limit the weight of the manufactured part,
- sufficient toughness to provide adequate residual strength of a damaged structure,
- good resistance to fatigue (crack propagation rate of pre-cracked specimens, and time to failure of notched and unnotched specimens) caused by vibrations and alternating stresses coming from successive takeoffs and landings,
- sufficient resistance to the different types of corrosion, and particularly stress corrosion and exfoliation corrosion.

Therefore, it is essential that an improvement in one property does not take place to the detriment of the other properties. For example, it is well known that the toughness of rolled products made of a given 2000 or 7000 alloy in general reduces when the yield strength increases.

Much work has been done to improve the strength-toughness balance of 7000 and 2000 alloys, both on the chemical composition of the alloy, and on its microstructure or its manufacturing procedure. For several decades, the emphasis has been placed on controlling the number, type and morphology of the various intermetallic phases that form during casting or during mechanical and heat treatments.

The article by J. T. STALEY "Microstructure and Toughness of High-Strength Aluminum Alloys" published in "Properties related to Fracture Toughness", ASTM Special Technical Publication 605, 1976, pp. 71–103, lists ten possible ways of increasing the toughness of aluminum alloys. This information has guided a great deal of subsequent research in this field. Concerning the chemical composition, research has been carried out on major additive elements (Zn, Mg, Cu) and on minor additives or impurities (Fe and Si in particular).

Thus, U.S. Pat. No. 3,762,916 to Olin Corp. recommends the addition of 0.05 to 0.4% of zirconium and 0.005 to 0.05% of boron, in order to improve the toughness of forged parts made of 7000 alloy. It states that high contents of titanium should be avoided, since they lead to intermetallic phases that reduce the toughness. The single example of a high content of titanium given in the patent is 0.49%.

Report AD/A-002875 by A. R. Rosenfield et al. "Research on Synthesis of High Strength Aluminum Alloys. Part 1. "The Relation between Precipitate Microstructure and Mechanical Properties in Aluminum Alloys", December 1974, prepared for the Air Force Materials Laboratory, studies the influence of the microstructure on the toughness and resistance to fatigue of 7075 alloy. It states that the dominant factor is the grain size of the transformed and treated product, and for sheet (1.6 mm thick) in the largely recrystallized state, the critical stress intensity factor $K_c$, varies as a function of the inverse of the square root of the grain size.

Patent EP 0473122 by Alcoa states that for AlCuMg alloys, the fact of obtaining a large grain unacceptably reduces some usage properties and particularly the toughness, formability and resistance to corrosion.

Therefore, the above comments should guide the metallurgist towards a fine structure for the product, and consequently a fine structure at the casting stage, particularly for microstructures with little recrystallization that retain some features, and in particular dimensional scale, of the cast structure after transformation and heat treatment.

SUMMARY OF THE INVENTION

The inventors found that for thick products with an only slightly recrystallized microstructure, a high as-cast grain size (that those skilled in the art would normally tend to avoid) could lead to a specific microstructure of the transformed and heat treated product that has a beneficial effect on the toughness, with no reduction in strength or other properties.

The object of the invention is a rolled, forged or extruded aluminum alloy product more than 12 mm thick, heat treated by solutionizing, quenching and artificial aging, with a microstructure characterized by the following parameters:

- the fraction of recrystallized grains measured between one-quarter thickness and mid-thickness of the final wrought product is smaller than 35% by volume;
- the characteristic intercept distance between recrystallized areas is greater than 250 μm, preferably greater than 300 μm and most preferably greater than 350 μm.

In a preferred embodiment of the invention, the alloy is an AlZnMgCu alloy with the following composition (% by weight): Zn:4–10 Mg: 1–4 Cu: 1–3.5 Cr<0.3 Zr<0.3 Si<0.5 Fe<0.5 other elements <0.05 each and <0.15 total, the remainder being aluminum, In another preferred embodiment, titanium is maintained between 0.01% by weight and 0.03% by weight, and boron between 1 and 10 μg/g.

Another object of the invention is a process for manufacturing such a product comprising:

- casting the alloy in the form of a rolling, forging or extrusion ingot, such that the as-cast grain size is kept between 300 and 800 μm,
- homogenization at a temperature greater than 430° C. and preferentially greater than 450° C. for more than 3 hours, and preferentially more than 6 hours, or even more than 12 hours,
- hot transformation at a controlled temperature to obtain a fraction of recrystallized grains measured between the quarter and half thickness of less than 35% by volume,
- solutionizing at a temperature between 450° C. and 490° C., quenching, possibly stress relaxation by controlled deformation (tension or compression), artificial aging.

DETAILED DESCRIPTION OF THE INVENTION

Figure 1:
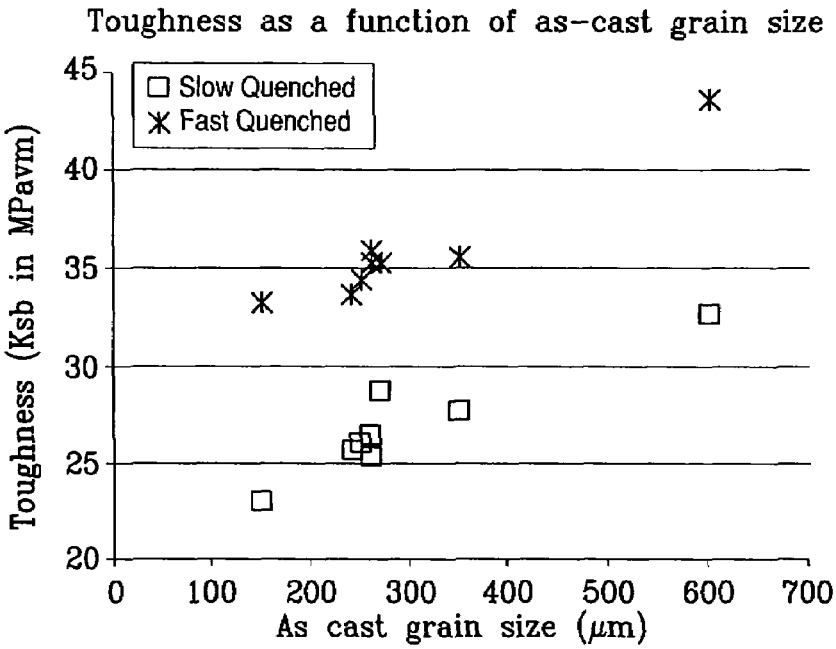
FIG. 1 shows, for AA7050 plates submitted to low and fast quenching according to Example 1, the relation between the toughness and the as-cast grain size.

The composition of major elements in the alloy may be the same as the composition of all alloys usually used in aeronautical construction. Iron and silicon are preferably kept below 0.15% to prevent the formation of intermetallic compounds that reduce toughness. For AlZnMgCu alloys, zirconium is preferable to chromium or manganese as an anti-recrystallizing agent since it is less sensitive to quenching and is therefore better for toughness. For thicker products, the content must be at least 0.05% if it is to have any effect on recrystallization, and shall be less than 0.18% Zr, or more preferably less than 0.13% Zr, in order to avoid sensitivity to casting problems.

The concentrations of titanium and boron in the alloy depend on the grain refining method employed. In general grain refining approaches are characterized by the use of nucleant particles that are present in the liquid at the moment of solidification (e.g. $TiB_2$, TiC, particles) and by the use of an element restricting grain growth (e.g. Ti). If an AlTiB master alloy is used for refining the grain during casting, the most frequently used is AT5B alloy with about 5% of Ti and 1% of B, and AT3B alloy with 3% of Ti and 1% of B. Grain refinement also depends on the nature of the raw materials in the melting bed, the recycled metal, particularly production scrap, leading to an increase in the content of Ti and B. In a preferred embodiment of this invention, this content should remain between 0.01% and 0.03% for Ti and between 1 μg/g and 10 μg/g for B.

The grain is refined by the formation of dispersed particles of $TiB_2$ that act as nucleants for the fine crystallization of the alloy during solidification. The grain size during casting does not depend solely on the Ti and B contents related to the composition and the content of refining agent introduced into the liquid metal and the nature of the melting bed, but on many other factors such as the method of introducing the refining agent, its dispersion in the liquid metal, the other elements present in the alloy which may have growth restricting effects (e.g. Zn, Cu), or solidification conditions, for example such as cooling rate.

The as-cast grain size is measured on a polished sample observed between crossed polars which has undergone a Barker's etch. The intercept method described in ASTM E 1382 is used.

The process according to the invention comprises casting a product (e.g. a billet or an ingot) in which the as-cast grain size is controlled at between 300 and 800 μm, whereas the normal as-cast grain size for alloys of this type is between 100 and 250 μm. The as-cast grain size must be kept below 800 μm to prevent difficulties with casting and a reduction in the elongation properties and the resistance to stress corrosion.

The cast ingots are homogenized at a temperature greater than 430° C. and more preferentially greater than 450° C. or even 470° C., and are then hot deformed by rolling, forging or extrusion. The temperature of this transformation must be sufficiently high to limit recrystallization. The recrystallization rate, measured in the part between one quarter thickness and mid-thickness of the final product, must be kept below 35%. It is measured by image analysis on micrographs, since the surface fractions of recrystallized grains can be seen in a light color on the dark unrecrystallized matrix. After deformation, the products are solution heat treated at a temperature between 450° C. and 500° C., and are then quenched, usually in water, by immersion or by fine spraying, possibly followed by stress relaxation by controlled tension or compression, and finally annealed.

The microstructure of wrought products according to the invention is different from the microstructure of wrought products according to prior art obtained from ingots with a typical as-cast grain size of less than 250 μm. The wrought products have a less recrystallized structure. The recrystallized areas form a network of a dimension related by a geometrical transformation to the size of the original as-cast grains. For example, a rolling reduction by a factor of two of a spherical cast grain of diameter $\alpha$ will generate a largely unrecrystallized grain whose geometry can be approximately characterized by an ellipsoid of axes $2\alpha$(L direction), $\alpha/2$ (ST direction), $\alpha$ (LT direction). The periphery of such a grain consists of an incomplete necklace of recrystallized grains. Intermetallic precipitates are observed at the heart of recrystallized areas, and probably act as nucleants for partial recrystallization. The distribution of these precipitates is more homogenous when the as-cast grain size is large.

It has been found that this microstructure of the wrought products has an influence on the product failure mode. Fractographic observations show that the failure mode for products according to the invention is principally transgranular, in particular for the T-L and L-T directions, whereas it is predominantly intergranular for thick products according to prior art. It could be assumed that this difference between failure modes is the cause of the significant improvement in the toughness, without affecting the mechanical strength or other physical properties necessary for aeronautical construction.

The products according to the invention can be used advantageously as thick plates for airframe structures, such as spars and ribs or wing skin plates. They can also be used as extrusions for airframe structures, such as stringers in general, and particularly wing stringers. They can also be used as forged parts for airframe structures. However, the applications of the products of the present invention are not limited to the aeronautical field.

EXAMPLES

Example 1

Ingots of cross section 500 mm×1600 mm made of AA7050 alloy with the position given in table 1 were cast:

TABLE 1

Chemical composition of alloys

| No | Zn % | Mg % | Cu % | Si % | Fe % | Zr % | Ti µg/g | B µg/g | Refinement kg/t |
|---|---|---|---|---|---|---|---|---|---|
| 1 | 6.03 | 1.99 | 2.12 | 0.027 | 0.06 | 0.11 | 60 | 5.3 | 0.5 |
| 2 | 6.08 | 2.10 | 2.11 | 0.025 | 0.06 | 0.11 | 152 | 2.1 | 0.5 |
| 3 | 6.10 | 2.12 | 2.22 | 0.028 | 0.06 | 0.11 | 315 | 2.0 | 0.1 |
| 4 | 6.10 | 2.12 | 2.22 | 0.026 | 0.06 | 0.11 | 335 | 5.1 | 0.5 |
| 5 | 6.22 | 2.07 | 2.17 | 0.027 | 0.06 | 0.11 | 101 | 2.0 | 0.5 |
| 6 | 6.17 | 2.05 | 2.22 | 0.029 | 0.06 | 0.11 | 140 | 5.0 | 0.5 |
| 7 | 5.96 | 2.01 | 2.17 | 0.030 | 0.06 | 0.08 | 123 | 3.3 | 0.1 |
| 8 | 5.99 | 2.08 | 2.20 | 0.026 | 0.06 | 0.11 | 189 | 2.0 | 0.1 |

Refining was done using AT5B rod, except for casting 6 which was refined with AT3B rod.

Samples were taken from the as-cast ingots at a quarter of the thickness and a third of the width for measuring the grain size, and test pieces were taken from the same location and were homogenized at 478° C. for 20 h, with a heat-up in 12 h. The test pieces were hot worked at 430° C. They were quenched in water, either at 100° C. at a cooling rate of 4.5° C./s to simulate industrial quenching of thick plates, or at 20° C., and were then solution heat treated for 3 h at 478° C. and stress relieved by compression in the ST direction with 1.5% deformation. They were then artificially aged in two steps of 6 h at 120° C. and then 21 h at 165° C. Two tensile test pieces in the TL direction and two toughness test pieces with B=12.7 mm (so-called Short Bar Specimens for the determination of $K_{sb}$, as described in Metals Handbook, 9$^{th}$ edition, Vol 8 "Mechanical Testing", p. 471, published by the American Society for Metals, Metals Park, Ohio), in the T-L direction, were taken from the deformed part of each test piece. The result of the various measurements is given in table 2.

TABLE 2

Properties of test pieces

| No | As-cast grain size [µm] | TYS slow quenching [MPa] (NOTE 1) | $K_{sb}$ slow quenching [MPa√m] (NOTE 1) | TYS fast quenching [MPa] (NOTE 2) | $K_{sb}$ fast quenching [MPa√m] (NOTE 2) |
|---|---|---|---|---|---|
| 1 | 600 | 435 | 32.6 | 462 | 43.6 |
| 2 | 250 | 434 | 26.0 | 476 | 34.3 |

TABLE 2-continued

Properties of test pieces

| No | As-cast grain size [µm] | TYS slow quenching [MPa] (NOTE 1) | $K_{sb}$ slow quenching [MPa√m] (NOTE 1) | TYS fast quenching [MPa] (NOTE 2) | $K_{sb}$ fast quenching [MPa√m] (NOTE 2) |
|---|---|---|---|---|---|
| 3 | 240 | 447 | 25.6 | 483 | 33.6 |
| 4 | 150 | 447 | 23.0 | 482 | 33.2 |
| 5 | 350 | 436 | 27.7 | 476 | 35.5 |
| 6 | 260 | 440 | 25.3 | 472 | 35.8 |
| 7 | 260 | 444 | 26.4 | 475 | 35.2 |
| 8 | 270 | 449 | 28.7 | 475 | 35.2 |

NOTE 1:
refers to mechanical properties measured at room temperature on test pieces quenched in boiling water.
NOTE 2:
refers to mechanical properties measured at room temperature on test pieces quenched in water at 20° C.

The toughness results as a function of the grain size are shown in FIG. 1. There is a clearly defined correlation between these values. It is also clear that there is no correlation of tensile yield strength with as cast grain size, and thus the identification of a mean of improving toughness of a given alloy composition with no loss in strength.

Example 2

Two industrial-scale casts of ingots of dimension 500 mm (ST)×1600 mm (LT)×3000 mm (L) of 7050 alloy were performed: the first corresponding to a control specimen, the second to a composition according to the present invention. These casts were practically identical except for the refining practices, which were in both cases by addition of 0.5 kg/t of AT5B rod, but for plates A and B into an alloy containing a total of 0.0326% Ti, plates C and D a total of 0.0138% Ti.

From each of these two casts, two ingots were selected for transformation to 152 mm (6") employing an identical standard plate fabrication route, including homogenization, pre-heating, hot rolling, solution heat treatment and cold water quenching, stretching, and aging to the T7451 condition.

The compositions and mechanical properties of plates A and B (prior art) and C and D (invention) are presented as tables 3 and 4 respectively. Plain strain fracture toughness was determined according to ASTM E 399.

Figure 2:
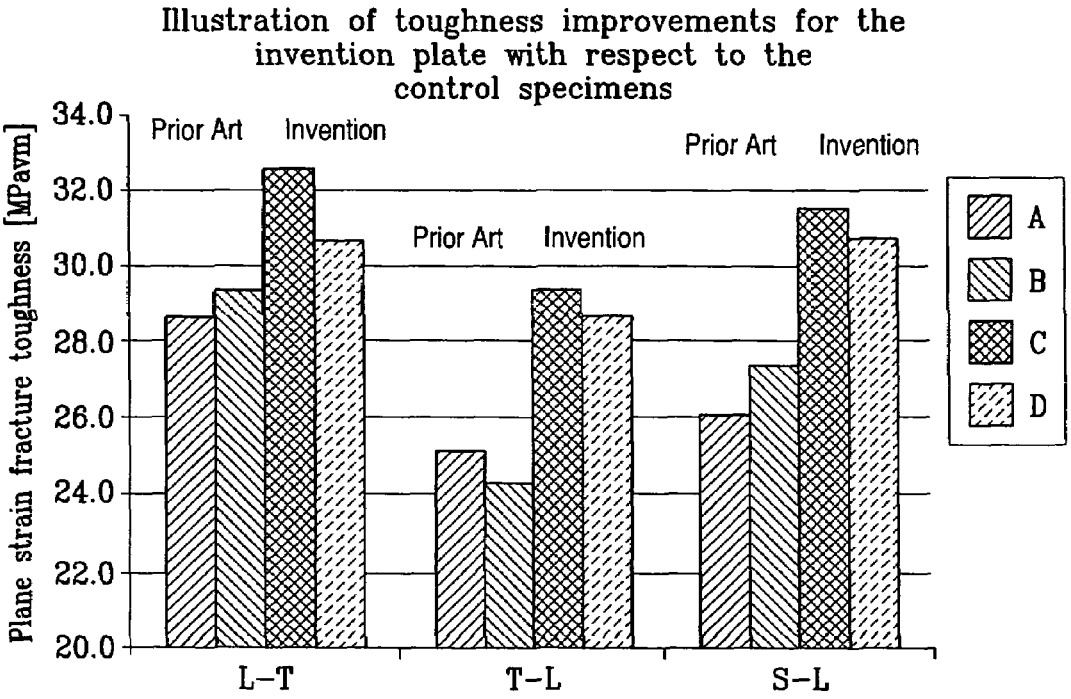
FIG. 2 is an illustration of toughness improvements for the invention plates C and D described in Example 2 with respect to prior art plates A and B.

All the plates show practically identical strengths but significant differences in fracture toughness (see also FIG. 2). Improvements in fracture toughness are observed in all three testing directions. The most significant improvements are observed in the S-L and T-L directions (respectively +4.5 and +4.3 MPa√m on average), but a significant improvement is also observed in the L-T direction (+2.6 MPa√m on average).

TABLE 3

Compositions of alloys for example 2.

| Plates | Si | Fe | Cu | Mn | Mg | Cr | Ni | Zn | Ti | Zr | Pb |
|---|---|---|---|---|---|---|---|---|---|---|---|
| A and B | 0.039 | 0.070 | 2.16 | 0.008 | 2.04 | 0.007 | 0.004 | 6.23 | 0.033 | 0.110 | 0.001 |
| C and D | 0.033 | 0.060 | 2.10 | 0.006 | 2.07 | 0.004 | 0.005 | 6.10 | 0.014 | 0.105 | 0.001 |

TABLE 4

Properties of plates for example 2.

| Plate | Orientation | UTS [MPa] | TYS [MPa] | Elongation [%] | Orientation | $K_{IC}$ [MPa√m] |
|---|---|---|---|---|---|---|
| | Tensile testing | | | | Toughness testing | |
| A (prior art) | L | 505 | 441 | 9.2 | L-T | 28.6 |
| | LT | 511 | 433 | 7.7 | T-L | 25.1 |
| | ST | 492 | 412 | 7.6 | S-L | 26.0 |
| B (prior art) | L | 513 | 452 | 8.6 | L-T | 29.4 |
| | LT | 514 | 436 | 7.0 | T-L | 24.3 |
| | ST | 500 | 424 | 6.6 | S-L | 27.3 |
| C (invention) | L | 500 | 437 | 9.9 | L-T | 32.6 |
| | LT | 508 | 429 | 7.8 | T-L | 29.3 |
| | ST | 490 | 414 | 7.1 | S-L | 31.5 |
| D (invention) | L | 502 | 437 | 9.6 | L-T | 30.7 |
| | LT | 510 | 433 | 6.7 | T-L | 28.6 |
| | ST | 489 | 407 | 7.0 | S-L | 30.7 |

Example 3

Image Analysis of Recrystallized Structures

Figure 4:
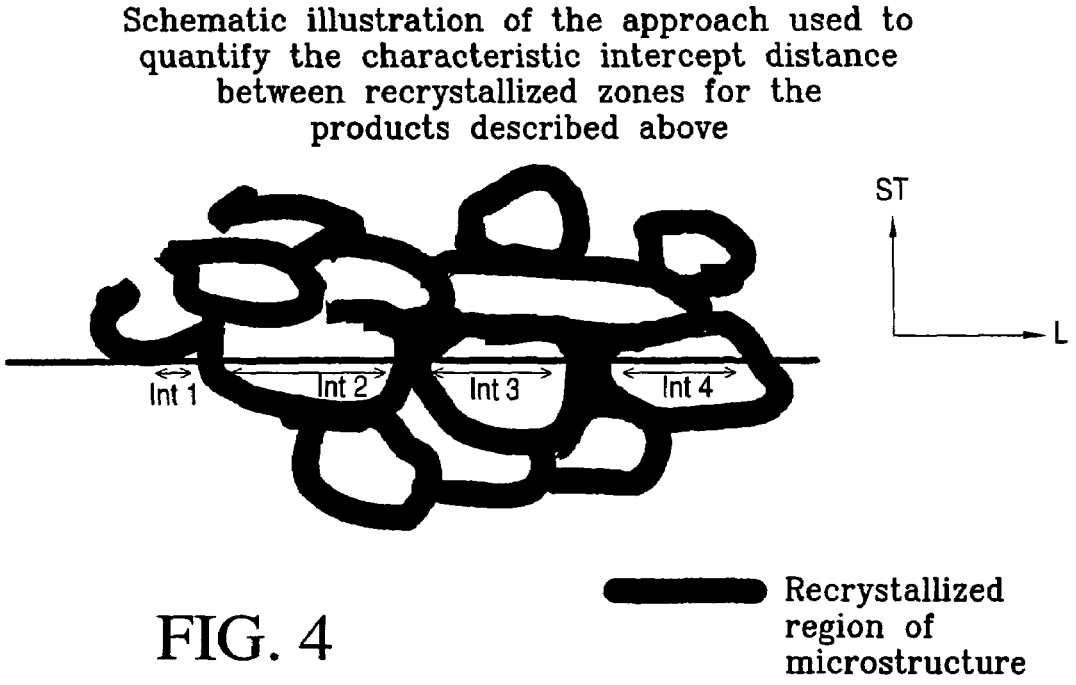
FIG. 4 is a schematic illustration of the approach used to quantify the characteristic intercept distance between recrystallized zones for products according Examples 1 and 3.
Figure 5A:
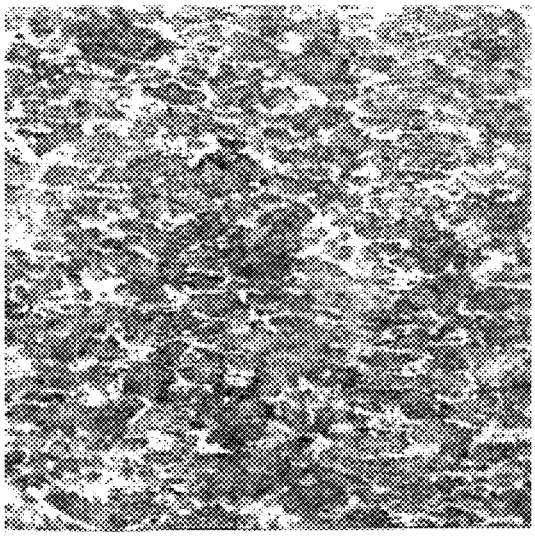
FIG. 5 is a comparison of microstructures of product numbers 4 (prior art, micrograph a) and 5 (invention, micrograph b) from example 1, obtained from samples taken in L-ST plane, treated with chromic etching, with a magnification of ×25. The darker areas correspond to unrecrystallized grains, the light areas to recrystallized grains.
Figure 5B:
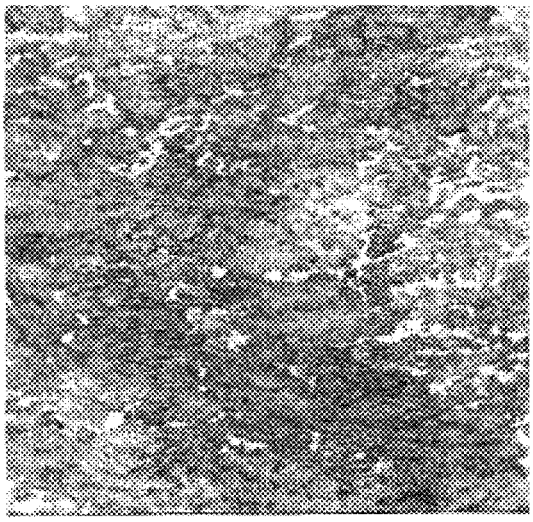

The distribution of recrystallized zones in wrought products according to the present invention is characteristically different from that in classical 7050 thick products. As can be observed in FIG. 5 (obtained from test piece number 5 in Table 2), the characteristic distance between recrystallized regions of the invention product is significantly larger than that of prior art (test piece number 4 in Table 2). This can be quantified by image analysis of etched L-ST micrographs. Any etch that generates contrast in the unrecrystallized regions can be exploited (e.g. chromic etch, Keller's etch). The approach used is described schematically in FIG. 4. For lines randomly placed in the L-direction of a micrograph obtained in the L-ST plane, individual intercept distances between recrystallized regions are measured (see intercept 1, intercept 2, intercept 3, intercept 4 in FIG. 4). A stable and representative mean of such intercepts is obtained for several thousand measurements, and this mean is taken to be the average intercept distance.

Figure 3:
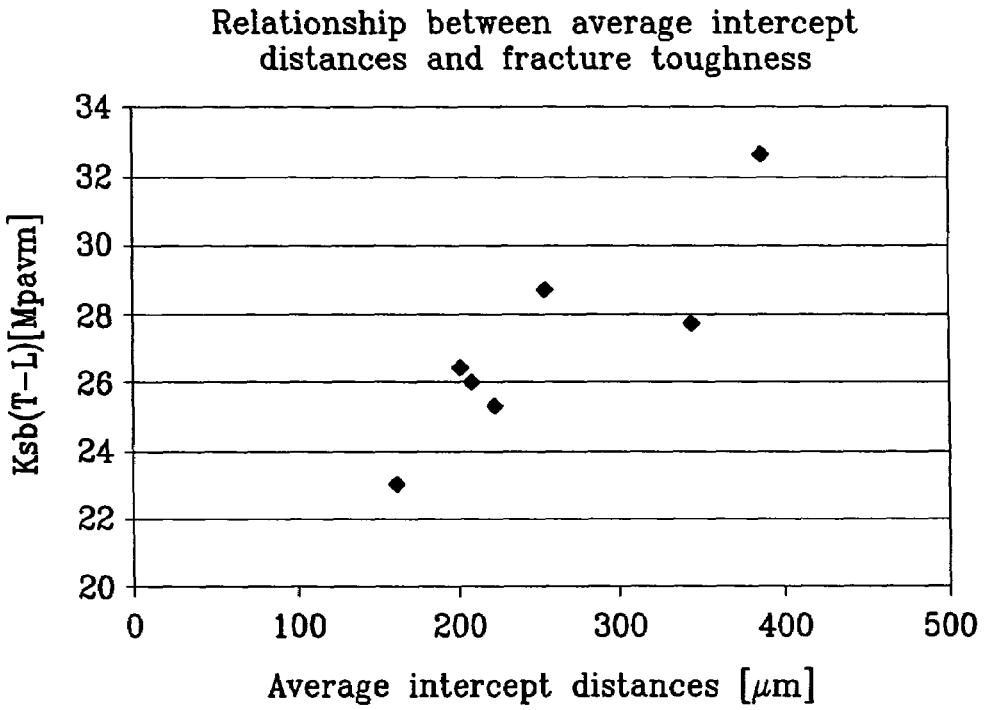
FIG. 3 is a graphical representation of the relationship between the fracture toughness and the average intercept distances as mentioned in Table 5 of Example 3.

Typical average intercept distances are presented as table 5 for products considered in example 1. A graphical representation of these results is presented as FIG. 3. It is clear that this parameter is well correlated to fracture toughness. Higher values of this average intercept give higher T-L toughnesses. Values greater than 250 μm, or preferably 300 or even 350 μm, are characteristic of the improved product.

It is clear that greater hot reductions will tend to elongate the structure to a greater extent in the L direction. However, the higher recrystallization rates typical of greater hot reductions will tend to compensate for the increased stretching of the microstructure in the L direction. It appears that in general, for plate thicker than approximately 100 mm, intercept distances greater than 250 μm, or preferably 300 or even 350 μm, will give improved toughness compared with conventional plate.

TABLE 5

Typical average intercept distances for the products considered in example 1.

| Product no. | Average intercept distance [μm] | $K_{sb}$ values |
|---|---|---|
| 1 (invention) | 384 | 32.6 |
| 2 (prior art) | 207 | 26 |
| 4 (prior art) | 160 | 23 |
| 5 (invention) | 343 | 27.7 |
| 6 (prior art) | 222 | 25.3 |
| 7 (prior art) | 200 | 26.4 |
| 8 (invention) | 253 | 28.7 |

The invention claimed is:

1. A partially recrystallized, rolled, forged or extruded AA7050 aluminum alloy product more than 12 mm thick, produced by casting an AA7050 aluminum alloy into a cast ingot having an as cast grain size between 270 and 800 μm, and heat treating the ingot by solution treating, quenching and artificial aging, a final wrought product produced thereby having a fraction of recrystallized grains measured between one-quarter thickness and mid-thickness less than 35% by volume, and a characteristic intercept distance between recrystallized areas greater than 250 μm.

2. The product according to claim 1, wherein the as-cast grain size is 270–600 μm.

3. The product according to claim 1, wherein the characteristic intercept distance is up to 384 μm.

* * * * *